US008383973B2

(12) United States Patent
Soininen et al.

(10) Patent No.: US 8,383,973 B2
(45) **Date of Patent: *Feb. 26, 2013**

(54) TRIPPING ASSEMBLY FOR SWITCHING DEVICE

(75) Inventors: Matti Soininen, Jukaja (FI); Aki Suutarinen, Vaasa (FI)

(73) Assignee: ABB Oy, Helsinki (FI)

( * ) Notice: Subject to any disclaimer, the term of this patent is extended or adjusted under 35 U.S.C. 154(b) by 137 days.

This patent is subject to a terminal disclaimer.

(21) Appl. No.: 12/971,800

(22) Filed: Dec. 17, 2010

(65) Prior Publication Data

US 2011/0147183 A1 Jun. 23, 2011

Related U.S. Application Data

(63) Continuation of application No. PCT/FI2009/050512, filed on Jun. 12, 2009.

(51) Int. Cl.
*H01H 3/00* (2006.01)

(52) U.S. Cl. ..... 200/329

(58) Field of Classification Search ..... 200/400, 200/336, 329, 50.21, 17 R, 50.32
See application file for complete search history.

(56) References Cited

U.S. PATENT DOCUMENTS

| | | | | |
|---|---|---|---|---|
| 2,797,591 | A | 7/1957 | Marrapese | |
| 5,438,176 | A * | 8/1995 | Bonnardel et al. | 200/400 |
| 5,886,311 | A | 3/1999 | Morel et al. | |
| 6,501,039 | B1 | 12/2002 | Mattlar et al. | |
| 6,940,032 | B2 * | 9/2005 | Sirajtheen et al. | 200/400 |

(Continued)

FOREIGN PATENT DOCUMENTS

| | | | |
|---|---|---|---|
| DE | 668 433 | C | 12/1938 |
| EP | 1 443 534 | A1 | 8/2004 |

(Continued)

OTHER PUBLICATIONS

International Search Report (PCT/ISA/210) issued on Oct. 7, 2009, by Finish Patent Office as the International Searching Authority for International Application No. PCT/FI2009/050512.

(Continued)

*Primary Examiner* — Edwin A. Leon
(74) *Attorney, Agent, or Firm* — Buchanan Ingersoll & Rooney PC

(57) ABSTRACT

A tripping assembly is provided for a switching device. The tripping assembly includes: a body part, a tripping axle configured to turn between a trip position and a tensioned position in relation to the body part; a tripping frame configured to turn between a trip position and a tensioned position in relation to the body part and whose turning axis is substantially parallel with the turning axis of the tripping axle; at least one tripping spring which has an non-tensioned state and a tensioned state and which is functionally connected to the tripping axle and to the tripping frame; a frame spring which has a non-tensioned state and a tensioned state and which is functionally connected between the body part and the tripping frame; and a connecting member which is arranged to functionally connect the tripping axle and the tripping frame both in the final stage of a tensioning event and in the initial stage of a tripping event. In the tripping event: (i) both the frame spring and the at least one tripping spring are configured to transfer from the tensioned state to the non-tensioned state, thus releasing energy needed for the tripping event to the tripping assembly; and (ii) the tripping frame and the tripping axle are configured to turn from their tensioned positions to their trip positions, and while doing so, to turn to opposite directions with respect to one another.

9 Claims, 7 Drawing Sheets

U.S. PATENT DOCUMENTS

| | | | | |
|---|---|---|---|---|
| 7,566,840 | B2 * | 7/2009 | Sudhakar et al. | 200/244 |
| 2007/0131528 | A1 | 6/2007 | Mattlar et al. | |
| 2011/0147184 | A1 * | 6/2011 | Soininen et al. | 200/336 |
| 2011/0147185 | A1 * | 6/2011 | Soininen et al. | 200/336 |

FOREIGN PATENT DOCUMENTS

| | | | |
|---|---|---|---|
| EP | 1 053 553 | B1 | 5/2006 |
| GB | 695 380 | A | 8/1953 |
| WO | WO 90/05375 | A1 | 5/1990 |
| WO | WO 2005/069323 | A1 | 7/2005 |
| WO | WO 2005/069324 | A1 | 7/2005 |
| WO | WO 2005/076302 | A1 | 8/2005 |

OTHER PUBLICATIONS

Written Opinion (PCT/ISA/237) issued on Oct. 7, 2009, by Finish Patent Office as the International Searching Authority for International Application No. PCT/FI2009/050512.

Search Report issued on Jan. 7, 2009, by Finish Patent Office for Application No. 20085616.

Soininen, Matti, et al., U.S. Appl. No. 12/971,833, entitled "Controller Unit for Switching Device," filed Dec. 17, 2010.

Soininen, Matti, et al., U.S. Appl. No. 12/973,028, entitled "Controller Unit for Switching Device," filed Dec. 20, 2010.

International Search Report (PCT/ISA/210) issued on Oct. 7, 2009, by Finnish Patent Office as the International Searching Authority for International Application No. PCT/F12009/050514.

Written Opinion (PCT/ISA/237) issued on Oct. 7, 2009, by Finnish Patent Office as the International Searching Authority for International Application No. PCT/FI2009/050514.

Finnish Search Report dated Jan. 9, 2009 for Application No. FI20085617.

International Search Report (PCT/ISA/210) issued on Oct. 7, 2009, by Finnish Patent Office as the International Searching Authority for International Application No. PCT/FI2009/050511.

Written Opinion (PCT/ISA/237) issued on Oct. 7, 2009, by Finnish Patent Office as the International Searching Authority for International Application No. PCT/FI2009/050511.

Finnish Search Report dated Jan. 12, 2009 for Application No. FI20085618.

U.S. Appl. No. 12/971833, Soininen et al.

U.S. Appl. No. 12/973026, Soininen et al.

* cited by examiner

TRIPPING ASSEMBLY FOR SWITCHING DEVICE

RELATED APPLICATIONS

This application claims priority as a continuation application under 35 U.S.C. §120 to PCT/FI2009/050512, which was filed as an International Application on Jun. 12, 2009 designating the U.S., and which claims priority to Finnish Application 20085616 filed in Finland on Jun. 19, 2008. The entire contents of these applications are hereby incorporated by reference in their entireties.

FIELD

The present disclosure relates to a tripping assembly for a switching device.

BACKGROUND INFORMATION

A switching device is a device with contact means for selectively providing an open state and a closed state in an electric circuit. An open position of the contact means is arranged to provide the open state of the electric circuit, and a closed position of the contact means is arranged to provide the closed state of the electric circuit. The switching device may be provided with a tripping assembly, which is functionally connected to the contact means of the switching device in such a manner that a tripping event of the tripping assembly is able to change the state of the contact means of the switching device from the closed position to the open position. The tripping assembly may be arranged to be remotely controlled by an electric signal.

An example of a switching device provided with a remote tripping assembly is disclosed in European Patent 1 053 553, entitled "Remote trip mechanism of a switch device".

SUMMARY

An exemplary embodiment provides a tripping assembly for a switching device. The tripping assembly has a trip state and a tensioned state. In a tensioning event, the tripping assembly is configured to transfer from the trip state to the tensioned state. In a tripping event, the tripping assembly is configured to transfer from the tensioned state to the trip state. The tripping assembly is configured to be functionally connected to contacts of the switching device such that the tripping event of the tripping assembly is able to change the state of the contacts of the switching device from a closed position to an open position. The tripping assembly includes a body part, and a tripping axle configured to turn between a trip position and a tensioned position in relation to the body part. The tripping assembly also includes a tripping frame configured to turn between a trip position and a tensioned position in relation to the body part. The tripping frame has a turning axis substantially parallel to a turning axis of the tripping axle. The tripping assembly also includes at least one tripping spring which has a non-tensioned state and a tensioned state. The at least one tripping spring is functionally connected to the tripping axle and to the tripping frame such that when the at least one tripping spring transfers from the tensioned state to the non-tensioned state, the tripping axle turns in relation to the tripping frame. In addition, the tripping assembly includes a frame spring which has a non-tensioned state and a tensioned state. The frame spring is functionally connected between the body part and the tripping frame. The tripping assembly also includes a connecting member configured to functionally connect the tripping axle and the tripping frame both in the final stage of a tensioning event and in the initial stage of a tripping event. In the tripping event, both the frame spring and the at least one tripping spring are configured to transfer from their tensioned state to their non-tensioned state, to release energy needed for the tripping event to the tripping assembly. Furthermore, in the tripping event, the tripping frame and the tripping axle are configured to turn from their tensioned positions to their trip positions, and while doing so, to turn to opposite directions with respect to one another.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Exemplary embodiments of the present disclosure provide a tripping assembly for a switching device.

The tripping assembly of the disclosure has a trip state and a tensioned state. In a tensioning event, the tripping assembly is configured to transfer from the trip state to the tensioned state. In a tripping event, the tripping assembly is configured to transfer from the tensioned state to the trip state. The tripping assembly is arranged to be functionally connected to the contact means of the switching device in such a manner that the tripping event of the tripping assembly is able to change the state of the contact means of the switching device from a closed position to an open position.

FIGS. 1 to 6 show sectional views of different modes of a controller unit of the switching device including the tripping assembly according to an exemplary embodiment of the present disclosure. The operation of the tripping assembly shown in FIGS. 7A, 7B, 8A and 8B corresponds to the operation of the tripping assembly of the controller unit in FIGS. 1 to 6. To better understand the exemplary embodiments of the present disclosure, it is useful to examine FIGS. 7A, 7B, 8A and 8B together with FIGS. 1 to 6.

Figure 1:
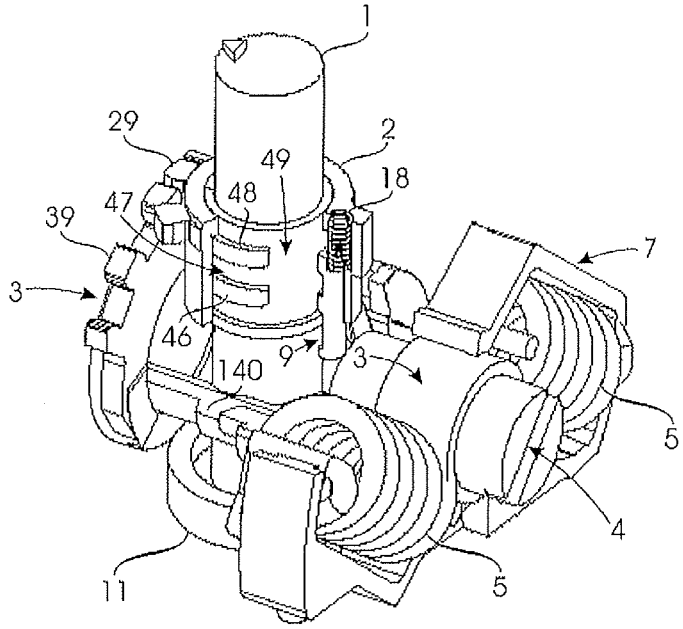
FIGS. 1 to 6 show sectional views of a controller unit of a modular switching device, including a tripping assembly according to an exemplary embodiment of the present disclosure.
Figure 10:
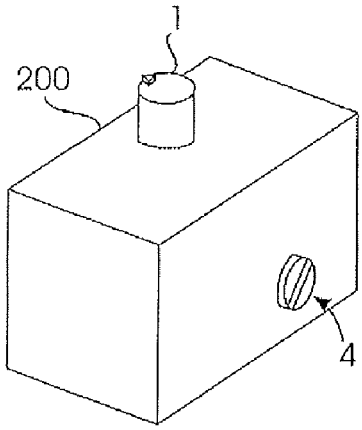
FIG. 10 shows the control unit of FIG. 1 provided with a body part.

The controller unit illustrated in the examples of FIGS. 1 to 6 includes a tripping axle 3, a tripping frame 7, two tripping springs 5, an operating axle 4, a connecting member 2, a control axle 1 and connecting means. The controller unit also includes a frame spring 17 and locking means 6 and 10, which are omitted from FIGS. 1 to 6 but shown in FIGS. 7A, 7B, 8A and 8B. A tripping event is started by releasing the locking means in a manner shown later. All components are mounted in the body part, which is omitted from FIGS. 1 to 6 but shown in FIG. 10. FIG. 10 shows a controller unit, in which the components of FIG. 1 are mounted in the body part 200.

The tripping axle 3 is arranged to turn between a trip position and a tensioned position in relation to the body part. The tripping frame 7 is arranged to turn between a trip position and a tensioned position in relation to the body part. The operating axle 4 is arranged to turn between an open position and a closed position in relation to the body part. The turning axes of the tripping axle 3, tripping frame 7 and operating axle 4 substantially converge, which means that the tripping axle 3, the tripping frame 7 and the operating axle 4 are mounted at the body part substantially coaxially. According to an exemplary embodiment, the respective turning axes of the tripping axle 3, tripping frame 7 and operating axle 4 are substantially parallel to each other.

According to an exemplary embodiment, each tripping spring 5 can be a pressure spring, one end of which is connected to the tripping frame 7 and the other end is connected to the tripping axle 3. Each tripping spring 5 has a non-tensioned state and a tensioned state. In the tensioned state, more energy is stored in the tripping spring 5 than in the non-tensioned state, and when the tripping spring 5 transfers from the tensioned state to the non-tensioned state, it is able to impart energy.

According to an exemplary embodiment, the frame spring 17 can be a pressure spring, which is connected between the body part and the tripping frame 7 and has a non-tensioned and tensioned state.

The operating axle 4 is arranged to be connected to the main axis of the switching device in such a manner that the open position of the operating axle 4 corresponds to the open position of the contact means of the switching device, and the closed position of the operating axle 4 corresponds to the closed position of the contact means. In the examples of FIGS. 1, 3, 4, 5 and 6, the operating axle 4 is in the open position, and in the example of FIG. 2 the operating axle 4 is in the closed position.

The connecting member 2 is a sleeve-like member, which is arranged to be turnable between the trip position and the tensioned position in relation to the body part. The connecting member 2 is supported so that it is not able to move axially in relation to the body part. The connecting member 2 is arranged to functionally connect the tripping axle 3 and the tripping frame 7, both in the final stage of a tensioning event and in the initial stage of a tripping event so that in these cases the tripping axle 3 and the tripping frame 7 turn in the opposite directions in relation to one another.

The connecting member 2 is functionally connected to the tripping axle 3 by providing the connecting member 2 with a plurality of connecting member teeth 29 and providing the tripping axle 3 with a plurality of tripping axle teeth 39, and by setting the connecting member 2 and the tripping axle 3 to such a position with respect to each other that the connecting member teeth 29 and the tripping axle teeth 39 are in a cogwheel connection with one another.

The connecting member 2 is functionally connected to the tripping frame 7 by providing the connecting member 2 with a turn tooth 38 and providing the tripping frame 7 with a turn projection 78, and by setting the connecting member 2 and the tripping frame 7 to such a position with respect to each other that the turn tooth 38 of the connecting member and the turn projection 78 of the tripping frame 7 are able to transmit torque between the connecting member 2 and the tripping frame 7 in the final stage of the tensioning event and in the initial stage of the tripping event. The turn tooth 38 and the turn projection 78 are shown in FIGS. 7A, 7B, 8A and 8B.

The control axle 1 is arranged to be turnable about its turning axis in relation to the body part. The turning axis of the control axle 1 is perpendicular to the turning axis of the operating axle 4. The control axle 1 is mounted coaxially to the connecting member 2. The control axle 1 has four positions: test position, off-position, trip position and on-position. The functional connection between the control axle 1 and the operating axle 4 is implemented in a manner described in publication WO 2005076302 "Switching device", which is incorporated herein by reference in its entirety. The control axle 1 is thus arranged to turn the operating axle 4 by means of an actuator 11.

The control axle 1 extends through the operating axle 4 in a manner known to a person skilled in the art from the above mentioned publications WO 2005076302 and WO 2005069323 "Switching device", for example. WO 2005069323 is also incorporated herein by reference in its entirety. The turning axes of the operating axle 4 and control axle 1 intersect.

A control handle, by which the user of the switching device may turn the control axle 1 manually, may be fastened to the control axle 1. Alternatively, a control motor capable of turning the control axle 1 may be connected to the control axle 1. It is also possible to use a combination of a control handle and a control motor, for example.

The control axle 1 and the connecting member 2 are functionally connected to one another through connecting means. The connecting means include, for example, a connecting pin 9, a spring 18 of the connecting pin and counterpart means formed on the outer surface of the control axle 1. The connecting means are in certain operating situations arranged to connect the control axle 1 to the connecting member 2 so that they rotate together coupled to one another, and in other operating situations they are arranged to allow the rotation of the control axle 1 and the connecting member 2 with respect to one another.

In the examples of FIGS. 1 to 6, part of the connecting member 2, tripping frame 7 and tripping axle 3 has been cut away for better illustration of the connecting means. A person skilled in the art understands that the entire tripping frame 7 is substantially symmetrical in that the tripping frame 7 surrounds the tripping springs 5 peripherally. Accordingly, the entire connecting member 2 surrounds the control axle 1 peripherally from all sides.

According to an exemplary embodiment, the connecting pin 9 is an elongated member, which is mounted in a pin hole in the connecting member 2. The pin hole is parallel to the rotational axes of the control axle 1 and connecting member 2. The connecting pin 9 includes a first contact member 91 and a second contact member 92, each of which is a radially inwards extending projection arranged to co-operate with the counterpart means.

The connecting pin 9 is able to axially move in the pin hole between the first position and the second position in relation to the connecting member 2. Since the connecting member 2 is in an axially fixed position in relation to the control axle 1, the connecting pin 9 is also able to move axially between the first position and the second position in relation to the control axle 1.

According to an exemplary embodiment, the spring 18 of the connecting pin is a helical spring, which is arranged to exert an axial force to the connecting pin 9, tending to transfer the connecting pin 9 from the second position to the first position. In the examples of FIGS. 1 to 6, the first position of the connecting pin 9 is an axially lower position and the second position is an axially upper position, whereby the spring 18 of the connecting pin is arranged to press the connecting pin 9 axially downwards. The body part supports the upper end of the spring 18 of the connecting pin, thus producing a counterforce to the force exerted by the connecting pin 9 to the spring 18 of the connecting pin.

The counterpart means are formed on the circumference of the control axle 1. The counterpart means include, for example, guide members 42, 44, 46, 48 and a guide opening 49. The counterpart means are arranged to co-operate with the connecting pin 9 to selectively connect the control axle 1 and the connecting member 2.

The guide members 42, 44, 46 and 48 are projections extending in the direction of the circumference on the outer surface of the control axle 1. The guide members 42 and 44 extend axially at a distance from one another so that a guide groove 43 is formed between them. In the direction of the circumference, the guide members 42 and 44 are equally long. In the direction of the circumference, the first end and second end of the guide member 42 are at the same locations as the first and second end of the guide member 44.

The guide members 46 and 48 extend axially at a distance from one another so that a guide groove 47 is formed between them. In the direction of the circumference, the guide members 46 and 48 are equally long. In the direction of the circumference, the first end and second end of the guide member 46 are at the same locations as the first and second end of the guide member 48. The guide members 46 and 48 resemble each other in other respects, too, and thus the higher guide member 48 in FIGS. 1 to 6 may be regarded as a copy of the lower guide element 46.

In the direction of the circumference, the guide members 42 and 44 are at a distance from the guide members 46 and 48 so that a guide opening 49 is formed between them. In the examples of FIGS. 1 to 6, the guide members 46 and 48 are located clockwise to the guide opening 49, e.g., on the left-hand side of the guide opening 49, and the guide members 42 and 44 are located anticlockwise to the guide opening 49, e.g., on the right-hand side of the guide opening 49. In the axial direction, the guide member 42 is below the guide member 46 and the guide member 44 is between the guide members 46 and 48.

The width of the guide member 44, e.g., the dimension parallel to the turning axis of the control axle 1, substantially equals the width of the guide member 46 and 48. The guide member 42 is wider than the guide members 44, 46 and 48. The width of the guide groove 43 and that of the guide groove 47 are substantially equal to the width of the guide members 44, 46 and 48.

Figure 9:
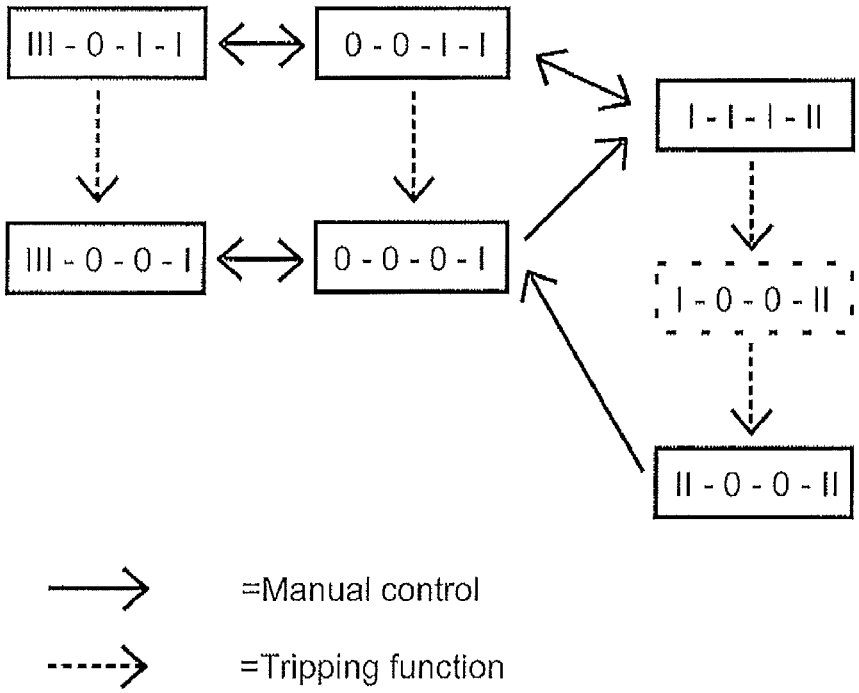
FIG. 9 shows a diagram, in which the positions of the components of the controller unit according to FIGS. 1 to 6 are shown in different modes.

The diagram of FIG. 9 shows the positions of the control axle 1, operating axle 4, tripping assembly and connecting pin 9 in different modes of the controller unit, and shifts of the controller unit between the different modes. In the diagram of FIG. 9, a manual shift from one mode to another is illustrated by a continuous arrow, whereas shifts from one mode to another caused by a tripping event are illustrated by discontinuous arrows. Each mode is marked with a mode code including four mode symbols separated by hyphens '-'.

The first mode symbol of each mode code represents the position of the control axle 1. The first mode symbol may obtain the value '0', when the control axle 1 is in the off-position, the value 'I', when the control axle 1 is in the on-position, the value 'II', when the control axle 1 is in the trip position, and the value 'III', when the control axle 1 is in the test position.

The second mode symbol represents the position of the operating axle 4. The second mode symbol may obtain the value '0', when the operating axle 4 is in the open position, and the value 'I', when the operating axle 4 is in the closed position. When the operating axle 4 is connected to the contact means of the switching device in order to control them, the value '0' of the second mode symbol corresponds to the open position of the contact means, and the value 'I' corresponds to the closed position of the contact means.

The third mode symbol represents the state of the tripping assembly. The third mode symbol may obtain the value '0', when the tripping assembly is in the trip state, and the value 'I', when the tripping assembly is in the tensioned state.

When the tripping assembly is in the trip state, the frame spring 17 is in the non-tensioned state, the tripping frame 7 is in the trip position, the tripping springs 5 are in the non-tensioned state, the tripping axle 3 is in the trip position, and the connecting member 2 is in the trip position. Accordingly, when the tripping assembly is in the tensioned state, the frame spring 17 is in the tensioned state, the tripping frame 7 is in the tensioned position, the tripping springs 5 is in the tensioned state, the tripping axle 3 is in the tensioned position, and the connecting member 2 is in the tensioned position.

The fourth mode symbol represents the position of the connecting pin 9. The fourth mode symbol may obtain the value 'I', when the connecting pin 9 is in its first position, and the value 'II', when the connecting pin 9 is in its second position.

Let us next examine the positions of the controller unit parts in different modes with reference to the examples of FIGS. 1 to 6 and to the diagram of FIG. 9.

In the example of FIG. 1, the controller unit is in the mode 0-0-0-I, whereby the control axle 1 is in the off-position, the operating axle 4 is in the open position, the tripping assembly is in the trip state, and the connecting pin 9 is in the first position.

Figure 2:
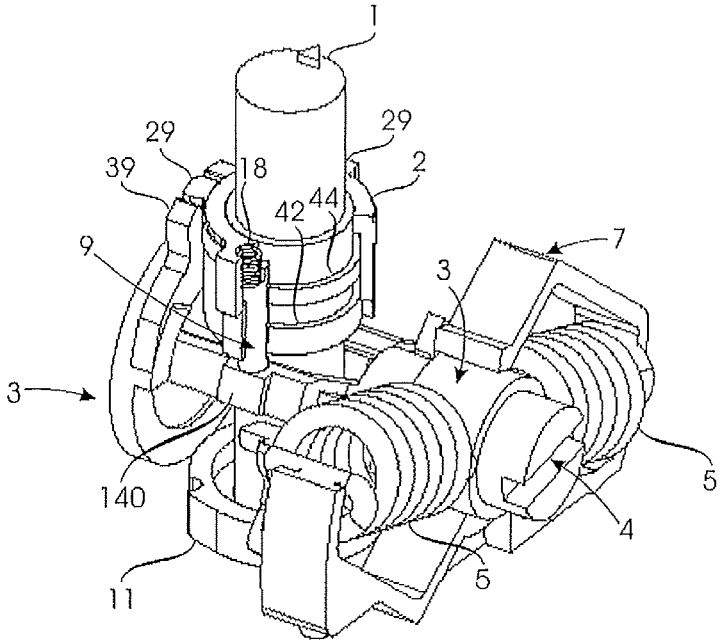

In the example of FIG. 2, the controller unit is in the mode I-I-I-II, whereby the control axle 1 is in the on-position, the operating axle 4 is in the closed position, the tripping assembly is in the tensioned position, and the connecting pin 9 is in the second position. For the tripping assembly, the shift from the mode of FIG. 1 to the mode of FIG. 2 is a tensioning event.

The shift from the mode 0-0-0-I of FIG. 1 to the mode I-I-I-II of FIG. 2 is carried out, for example, by turning the control axle 1 90° clockwise, e.g., from the off-position to the on-position. The connecting member 2 turns along with the control axle 1 90° clockwise, e.g., from its trip position to its tensioned position. The tripping axle 3 turns from its trip position to its tensioned position due to the cogwheel connection between the connecting member teeth 29 and the tripping axle teeth 39.

In the initial stage of the tensioning event, the tripping frame 7 tends to rotate clockwise with the tripping axle 3, because the tripping axle 3 exerts a torque to the tripping frame 7 via the tripping springs 5. However, according to the illustrated exemplary embodiment, the tripping frame 7 is not allowed to rotate clockwise from its trip position, because the body part prevents the tripping frame from rotating clockwise by exerting a supporting force to it. Thus, the tripping axle 3 turns in relation to the tripping frame 7, and the tripping springs 5 are compressed.

In the final stage of the tensioning event, the tripping frame 7 turns anticlockwise from its trip position to its tensioned position, pressing the frame spring 17 to the tensioned state. The tripping axle 3 and the tripping frame 7 thus turn to opposite directions with respect to one another. The tripping frame 7 turns to the tensioned position as a result of the co-operation of the turn tooth 38 in the connecting member 2 and the turn projection 78 in the tripping frame 7. The turn tooth 38 and the turn projection 78 are shown in FIGS. 7A, 7B, 8A and 8B, as was stated above.

In the tensioning event, the tripping springs 5 transfer from the non-tensioned state to the tensioned state. When the tripping springs 5 transfer from their non-tensioned state to their tensioned state, they pass by their dead point where they do not tend to turn the tripping axle 3 in relation to the tripping frame 7. In their tensioned state, the tripping springs 5 actually tend to turn the tripping axle 3 clockwise and the tripping frame 7 anticlockwise. The tensioned state of the tripping springs 5 is close to the dead point, wherein the torques exerted by the tripping springs 5 to the tripping axle 3 and the tripping frame 7 are relatively small.

In an alternative embodiment of the present disclosure, the tripping springs 5 can be arranged to be in their tensioned state at the dead point. In another alternative embodiment, the tripping springs 5 can be in their tensioned state arranged to be on that side of their dead point where they tend to turn the tripping axle 3 towards its trip position.

As described above, the connecting member 2 turns along with the control axle 1 when the mode changes from 0-0-0-I to I-I-I-II. The connecting member 2 turns with the control axle 1 as a result of the co-operation of the first contact member 91 and second contact member 92 of the connecting pin with counter surfaces 491 and 492. The first counter surface 491 and the second counter surface 492 can be seen in FIGS. 3 and 4. The first counter surface 491 is formed by the perimetral end of the guide member 42, and the second counter surface 492 is formed by the perimetral end of the guide member 44.

When the control axle 1 is turned from the off-position to the on-position, the operating axle 4 turns from its open position to the closed position by means of the actuator 11. FIG. 2 shows that when the operating axle 4 turns from the open position to the closed position, the operating axle 4 is arranged to be in contact with the connection pin 9 by means of a pin transferring projection 140 in order to transfer it from the first position to the second position. In other words, before the operating axle 4 reaches its closed position, the pin transferring projection 140 touches the lower surface of the connecting pin 9 and lifts the connecting pin 9 to its upper position while the operating axle 4 reaches its closed position.

The movement of the connecting pin 9 from its first position to its second position pushed by the pin transferring projection 140 of the operating axle 4 is possible, because the connecting pin 9 is located at the guide opening 49. The guide opening 49 allows the axial movement of the connecting pin 9 between the first and the second position.

Figure 3:
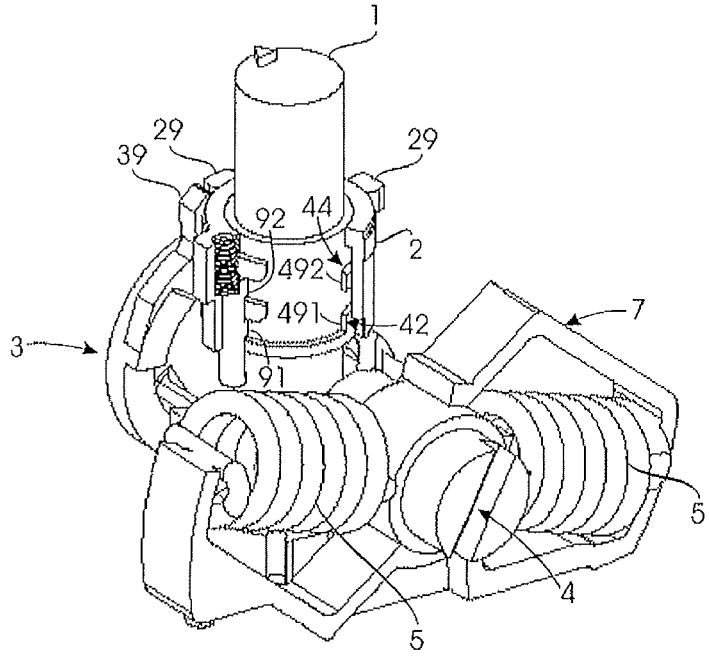

The shift from the mode I-I-I-II of FIG. 2 to the mode 0-0-I-I of FIG. 3 is carried out by turning the control axle 1 90° anticlockwise, e.g., from the on-position to the off-position. In this case, the tripping assembly remains in its tensioned state, and thus the connecting member 2 also remains in its tensioned position and turns 90° clockwise in relation to the control axle 1. The operating axle 4 for its part turns to the open position and the connecting pin 9 moves to the first position. The connecting pin 9 moves to the first position, because the pin transferring projection 140 of the operating axle 4 no longer exerts force on the lower end of the connecting pin 9, whereby the spring 18 of the connecting pin 9 presses the connecting pin 9 to its lower position. FIG. 3 shows that, in the mode 0-0-I-I, the connecting pin 9 is no longer at the guide opening 49 but at the guide members 46 and 48, and the other contact member 92 is in the guide groove 47. The connecting pin 9 has transferred to its first position while the connecting pin 9 was still at the guide opening 49.

Figure 4:
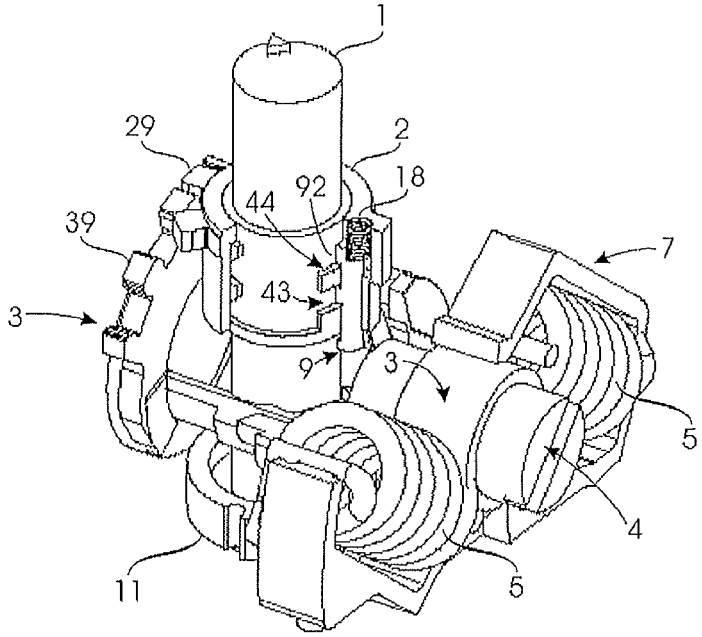

The shift from the mode I-I-I-II of FIG. 2 to the mode II-0-0-II of FIG. 4 is caused by a tripping event. In this case, the frame spring 17 transfers from the tensioned state to the non-tensioned state and turns the tripping frame 7 from the tensioned position to the trip position. In the initial stage of the tripping event, the tripping axle 3 is forced to turn to the direction opposite to that of the tripping frame 7 by the connecting member 2. In the initial stage of the tripping event, the turn projection 78 of the tripping frame transmits torque to the connecting member 2 via the turn tooth 38, and the connecting member 2 transmits the torque to the tripping axle 3 by means of the cogwheel connection between the connecting member 2 and the tripping axle 3. As was stated in the description of the tripping event, the turn tooth 38 and the turn projection 78 are shown in FIGS. 7A, 7B, 8A and 8B.

In the beginning of the tripping event, the role of the connecting member 2 is significant, because it makes the tripping axle 3 turn in relation to the tripping frame 7 to the extent that the tripping springs 5 are transferred to the other side of their dead point, so far from the dead point that the tripping springs 5 are able to turn the tripping axle 3 to its trip position.

Figure 11:
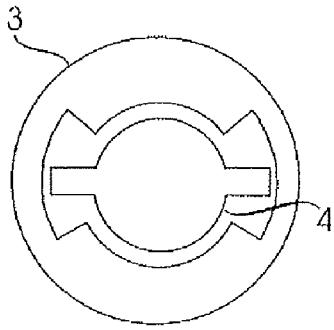
FIG. 11 shows a functional connection between a tripping axle and an operating axle according to an exemplary embodiment of the present disclosure.

In the tripping event, the tripping axle 3 turns the operating axle 4 directly by means of the functional connection between the tripping axle 3 and the operating axle 4. Thus, in the tripping event, force is not transmitted from the tripping axle 3 to the operating axle 4 via the control axle 1. The functional connection between the tripping axle 3 and the operating axle 4 is arranged such that when the tripping axle 3 is in the tensioned position, the operating axle 4 may freely turn between the open position and the closed position without the tripping axle 3 needing to turn. An example of providing a functional connection between the tripping axle 3 and the operating axle 4 is shown in FIG. 11 in a simplified manner.

When the mode changes from I-I-I-II to II-0-0-II, the control axle 1 turns to the trip position, which is in the middle of the on-position and the off-position. The trip position of the control axle 1 is thus 45° anticlockwise to the on-position and 45° clockwise to the off-position.

The control axle 1 is turned to the trip position by the operating axle 4 via the actuator 11. No torque is transmitted between the connecting member 2 and the control axle 1 when the mode changes from I-I-I-II to II-0-0-II, because in this mode shift the first contact member 91 of the connecting pin 9 glides in the guide groove 43, and the second contact member 92 of the connecting pin 9 glides on the upper surface of the guide member 44.

The shift from the mode II-0-0-II of FIG. 4 to the mode 0-0-0-I of FIG. 1 is carried out by turning the control axle 1 45° anticlockwise, e.g., from the trip position to the off-position. The turning of the control axle 1 from the trip position to the off-position has no effect on the position of the operating axle 4 or the state of the tripping assembly. Instead, the connecting pin 9 transfers from its second position to its first position after reaching the guide opening 49.

The shift from the mode 0-0-I-I of FIG. 3 to the mode 0-0-0-I of FIG. 1 is caused by a tripping event. For the tripping assembly, such a mode shift is substantially identical with the above described shift between the modes I-I-I-II and II-0-0-II. The control axle 1 remains in its off-position and the connecting member 2 turns 90° anticlockwise to it. The connecting pin 9 remains in its first position.

Figure 5:
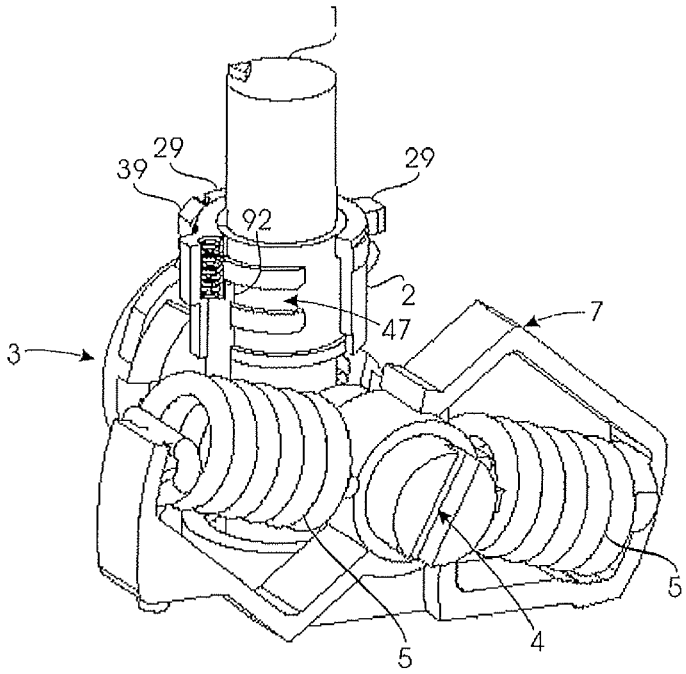

The shift from the mode 0-0-I-I of FIG. 3 to the mode III-0-I-I of FIG. 5 is carried out by turning the control axle 1 45° anticlockwise from the off-position, whereupon the control axle 1 reaches the test position. This mode shift has no effect on the position of the operating axle 4 or the state of the tripping assembly. The connecting member 2 turns 45° clockwise in relation to the control axle 1 as the second contact member 92 of the connecting pin 9 glides in the guide groove 47.

Figure 6:
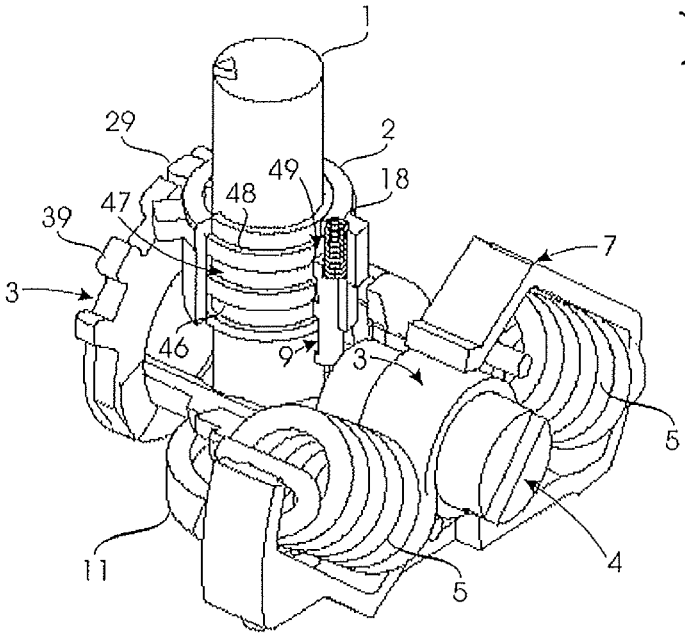

The shift from the mode III-0-I-I of FIG. 5 to the mode III-0-0-I of FIG. 6 is caused by a tripping event. For the tripping assembly, this mode shift is substantially identical with the above described shift between the modes I-I-I-II and II-0-0-II. The control axle 1 remains in its test position and the connecting member 2 turns 90° anticlockwise to it. The connecting member 9 remains in its first position.

The shift from the mode III-0-0-I of FIG. 6 to the mode 0-0-0-I of FIG. 1 is carried out by turning the control axle 1 45° clockwise, whereupon the control axle 1 reaches the off-position. The shift between these modes has no effect on the position of the operating axle 4 or the state of the tripping assembly. The connecting member 2 turns 45° anticlockwise to the control axle 1. The connecting pin 9 is in the guide opening 49 during the whole time of the mode shift.

A person skilled in the art understands that the shift from the mode 0-0-0-I to the mode III-0-0-I occurs in reverse order as the shift from the mode III-0-0-I to the mode 0-0-0-I. Accordingly, the shift from the mode 0-0-I-I to the mode I-I-I-II occurs in reverse order as the shift from the mode I-I-I-II to the mode 0-0-I-I, and the shift from the mode III-0-I-I to the mode 0-0-I-I occurs in reverse order as the shift from the mode 0-0-I-I to the mode III-0-I-I. The reciprocity of these three mode shifts is illustrated in the diagram of FIG. 9 by bidirectional arrows.

When the control axle 1 is in the test position shown in FIGS. 5 and 6, a test function of the switching device may be achieved, which is known to a person skilled in the art from publication WO 2005076302, for example.

The mode I-0-0-II shown in the diagram of FIG. 9 is an unstable state, which only occurs when the user holds the handle of the control axle 1 during the tripping event. When the user lets go of the handle, the control axle 1 turns to its trip position, forced by a non-shown spring. The operation of this spring is described in publication WO 2005076302.

The controller unit of FIGS. 1 to 6 and 10 is a modular controller unit of the switching device. In addition to a controller module, the modular switching device includes one or more contact modules, which constitute at least part of the contact means of the switching device. Forces that are necessary for changing the state of the contact means are transmitted from the controller module to one or more contact modules by the operating axle 4. The modular switching device is known to a person skilled in the art from publication WO 2005069324 "Modular switching device", for example. WO 2005069324 is incorporated herein by reference in its entirety.

In the modular switching device, the controller unit and each contact module include their own body parts. According to an exemplary embodiment, the tripping assembly of the present disclosure may also be used in an integrated switching device, which means that the tripping assembly may be mounted in the same body part as the contact means.

Figure 7A:
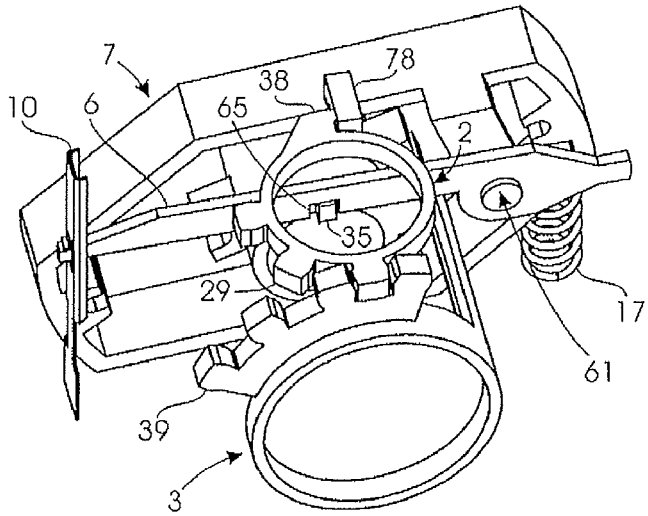
FIGS. 7A and 7B show the tripping assembly in a tensioned state.
Figure 7B:
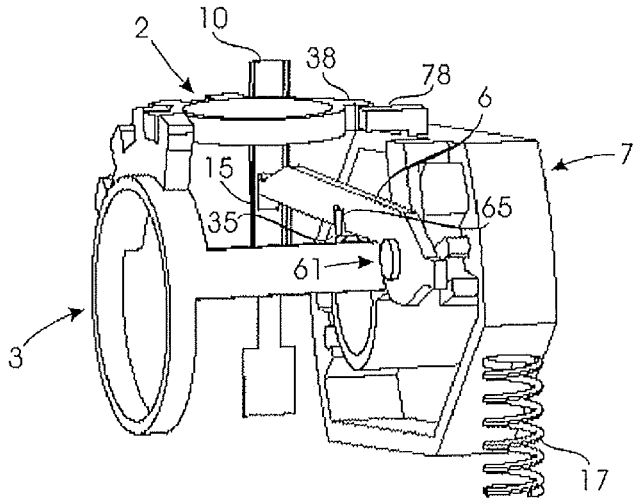
Figure 8A:
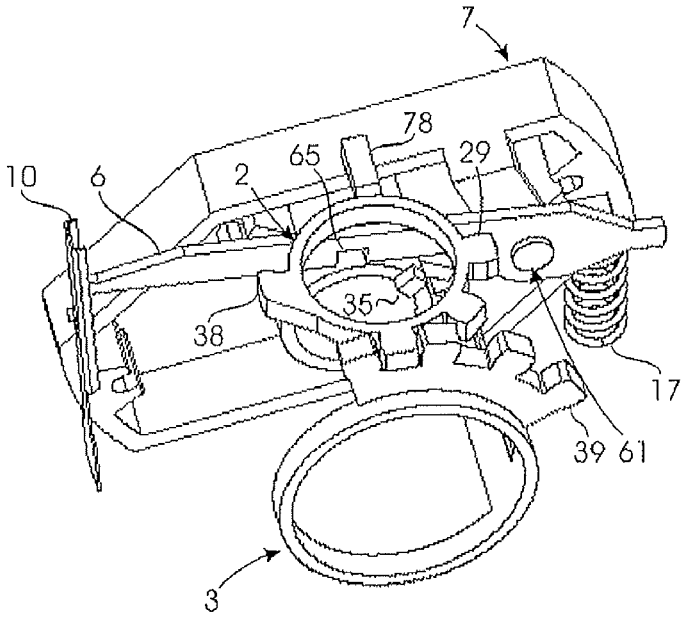
FIGS. 8A and 8B show the tripping assembly in a trip state.
Figure 8B:
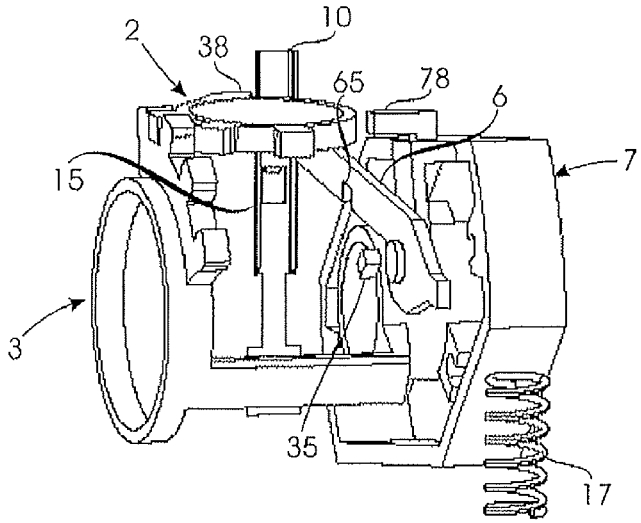

Let us next examine the tripping assembly shown in FIGS. 7A, 7B, 8A and 8B. As stated above, the tripping assembly of these drawings operates in the same manner as the tripping assembly shown in the examples of FIGS. 1 to 6. In FIGS. 7A and 7B, the tripping assembly is in a tensioned state, its mode corresponding to that of the tripping assembly of the controller units according to FIGS. 2, 3 and 5. In FIGS. 8A and 8B, the tripping assembly is in a trip state, its mode corresponding to that of the tripping assembly of the controller units according to FIGS. 1, 4 and 6. The shift from the situation of FIGS. 7A and 7B to the situation of FIGS. 8A and 8B is caused by a tripping event.

The tripping assembly of FIGS. 7A, 7B, 8A and 8B includes a tripping axle 3, a tripping frame 7, a frame spring 17, a connecting member 2 and locking means. The tripping assembly also includes two tripping springs, the location and operation of which are identical with those of the tripping springs of the tripping assembly of the controller unit according to FIGS. 1 to 6.

The tripping assembly of FIGS. 7A, 7B, 8A and 8B is arranged to be connected to the main axis of the switching device by means of the tripping axle 3. In this case, the tensioning of the tripping assembly is carried out by turning the main axis of the switching device to the closed position. In the tripping event, respectively, the tripping axle 3 turns the main axis of the switching device via the functional connection between the tripping axle 3 and the main axis of the switching device. The functional connection between the tripping axle and the main axis of the switching device may be fixed, or it may be arranged to be similar to the functional connection between the tripping axle 3 and the operating axle 4, as shown in FIG. 11. In that case, when the tripping axle is in the tensioned position, the main axis of the switching device may freely turn between the open position and the closed position without the tripping axle needing to turn. The tripping assembly of FIGS. 7A to 8B may practically be mounted in any switching device with a main axis.

The locking means have a locking state and a trip state. In the locking state according to FIGS. 7A and 7B, the locking means lock the tripping assembly to the tensioned state. The tripping event is started by releasing the locking means in such a manner that they allow the tripping assembly to shift from their tensioned state to the trip state. When the tripping event ends, the locking means are in the trip state according to FIGS. 8A and 8B.

According to an exemplary embodiment, the locking means include a locking lever 6 and a locking clamp 10, each of which has a locking position and a trip position. When the locking means are in the locking state, the locking lever 6 and the locking clamp 10 are in the locking position. When the locking means are in the trip state, the locking lever 6 and the locking clamp 10 are in the trip position.

The locking lever 6 is an elongated member, which is pivoted at a pivot point 61 to the tripping frame 7 in such a manner that the turning axis of the locking lever 6 is parallel to the turning axis of the tripping frame 7 and is located at a distance therefrom. The locking lever 6 has a longer lever arm part extending from the pivot point 61 of the locking lever towards the locking clamp 10, and a shorter lever arm part extending from the pivot point 61 of the locking lever away from the locking clamp 10.

In the locking state of the locking means, a first and second supporting force are exerted to the locking lever 6, the co-operation of which prevents the locking lever 6 from rotating about the pivot point 61 of the locking lever and in relation to the body part. The first supporting force is exerted by the body part on the shorter lever arm part of the locking lever 6, and the second supporting force is exerted by the locking clamp 10 close to the distal end of the longer lever arm part of the locking lever 6.

In its locking position, the locking clamp 10 is arranged to hold the locking lever 6 in the locking position of the locking lever and, when released, to allow the movement of the locking lever 6 from the locking position of the locking lever to the trip position of the locking lever. The locking clamp 10 includes an elongated rectangular member, the first axial end of which is fixedly connected to the body part. When the locking clamp 10 is in the locking position, it is substantially perpendicular to both the locking lever 6 and the turning axis of the locking lever 6. The locking clamp 10 includes a clamp opening 15, which receives the distal end of the longer lever arm part of the locking lever 6 when the locking means are in the locking state. The clamp opening 15 is on that side of the longitudinal middle point of the locking clamp 10 that is closer to the second axial end. The locking clamp 10 exerts the second supporting force on the locking lever 6 via the rim of the clamp opening 15.

In the tripping event, the shift to the trip state of the locking means is carried out by moving the second axial end of the locking clamp 10 away from the pivot point 61 of the locking lever in such a manner that the distal end of the longer lever arm part of the locking lever 6 is no longer received in the clamp opening 15. In this case, the locking clamp 10 does not exert the second supporting force close to the distal end of the longer lever arm part of the locking lever 6, thus allowing the locking lever 6 to rotate about the pivot point 61. The rotation of the locking lever 6 about the pivot point 61 allows, for its part, the turning of the tripping frame 7 from its tensioned position to its trip position.

The locking lever 6 includes a locking slot 65 arranged to co-operate with a locking projection 35 provided in the tripping axle 3. When the locking lever 6 is in the locking position, the locking projection 35 is in the locking slot 65, and the co-operation of the locking projection 35 and the locking slot 65 prevents the tripping axle 3 from turning away from the tensioned position. When the locking lever 6 is in the trip position, the locking projection 35 and the locking slot 65 do not co-operate, and thus the locking lever 6 allows the tripping axle 3 to turn to the trip position.

The locking clamp 10 may be arranged to be manually transferred from the locking position to the trip position by a movable knob. Alternatively or in addition, the locking clamp 10 may be arranged to be transferred from the locking position to the trip position by means of a solenoid, for example.

The transfer of the locking clamp 10 from the locking position to the trip position requires little force, since the locking clamp 10 is located far from the pivot point 61 of the locking lever. The locking means thus utilize a lever arm.

The small amount of force required for using the locking clamp 10 is advantageous for instance in embodiments in which the locking clamp 10 is arranged to be transferred from the locking position to the trip position by means of a solenoid. For safety reasons, the solenoid can be arranged to operate according to the holding current principle, which means that holding current must be supplied to the solenoid all the time in order to keep the locking clamp 10 in the locking position. The smaller the force required for using the locking clamp 10, the smaller the required holding current.

In the tripping assembly of FIGS. 7A to 8B, the connecting member is sleeve-like, for example. In embodiments where the control axle does not extend coaxially to the connecting member, the connecting member can alternatively be shaped as a cogwheel, which does not include an opening arranged to receive the control axle. Furthermore, the connecting member may be shaped, for example, into an elongated bar, the turning axis of which is perpendicular to the longitudinal direction of the bar. The first end of the bar is arranged to co-operate with the tripping frame, and the second end of the bar is arranged to co-operate with the tripping axle.

It will be appreciated by a person skilled in the art that features of the present disclosure may be implemented in many different ways. The present disclosure and its embodiments are thus not restricted to the above examples, but may vary within the scope of the claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A tripping assembly for a switching device, the tripping assembly having a trip state and a tensioned state and, in a tensioning event, the tripping assembly is configured to transfer from the trip state to the tensioned state and, in a tripping event, the tripping assembly is configured to transfer from the tensioned state to the trip state, wherein the tripping assembly is configured to be functionally connected to contacts of the switching device such that the tripping event of the tripping assembly is able to change the state of the contacts of the switching device from a closed position to an open position, wherein the tripping assembly comprises:

a body part;

a tripping axle configured to turn between a trip position and a tensioned position in relation to the body part;

a tripping frame configured to turn between a trip position and a tensioned position in relation to the body part, the tripping frame having a turning axis substantially parallel to a turning axis of the tripping axle;

at least one tripping spring which has a non-tensioned state and a tensioned state, the at least one tripping spring being functionally connected to the tripping axle and to the tripping frame such that when the at least one tripping spring transfers from the tensioned state to the non-tensioned state, the tripping axle turns in relation to the tripping frame;

a frame spring which has a non-tensioned state and a tensioned state, the frame spring being functionally connected between the body part and the tripping frame; and a connecting member configured to functionally connect the tripping axle and the tripping frame both in the final stage of a tensioning event and in the initial stage of a tripping event, wherein, in the tripping event:

both the frame spring and the at least one tripping spring are configured to transfer from their tensioned state to their non-tensioned state, to release energy needed for the tripping event to the tripping assembly; and the tripping frame and the tripping axle are configured to turn from their tensioned positions to their trip positions, and while doing so, to turn to opposite directions with respect to one another.

2. A tripping assembly as claimed in claim 1, wherein the at least one tripping spring has a dead point in which the at least tripping spring does not tend to turn the tripping axle in relation to the tripping frame, wherein, in the tensioned state of the tripping assembly, the at least one tripping spring is close to its dead point.

3. A tripping assembly as claimed in claim 2, wherein, in the tensioned state of the tripping assembly, the at least one tripping spring is on that side of the dead point of the at least tripping spring where the at least one tripping spring tends to turn the tripping axle away from the trip position.

4. A tripping assembly as claimed in claim 2, wherein in the initial stage of the tripping event, the tripping frame is configured to turn the tripping axle in relation to the tripping frame by means of the connecting member such that the tripping axle reaches a position in which the at least one tripping spring is able to exert a force on the tripping axle, sufficient to turn the tripping axle to the trip position.

5. A tripping assembly as claimed in claim 1, wherein the tripping assembly also comprises locking means which have (i) a locking state, in which the locking means are configured to lock the tripping frame to its tensioned position, and (ii) a trip state, in which the locking means are configured to allow the transfer of the tripping frame from its tensioned position to its trip position.

6. A tripping assembly as claimed in claim 5, wherein the locking means comprise a locking lever and a locking clamp, the locking lever being pivoted at a pivot point to the tripping frame such that the turning axis of the locking lever is parallel to the turning axis of the tripping frame, and is located at a distance from the turning axis of the tripping frame, wherein, in the locking state of the locking means, the locking clamp exerts a supporting force on the locking lever to hold the locking lever in the locking position, and the tripping event is started by transferring the locking clamp in relation to the locking lever such that the supporting force is eliminated.

7. A tripping assembly as claimed in claim 5, wherein, in the locking state of the locking means, the locking means are configured to lock the tripping axle in its tensioned position.

8. A tripping assembly as claimed in claim 1, wherein the tripping axle is configured to be functionally connected to the contacts of the switching device such that in the tensioned position of the tripping axle, the state of the contact means of the switching device is changeable between the closed position and the open position while the tripping axle remains in the tensioned position.

9. A tripping assembly as claimed in claim 3, wherein in the initial stage of the tripping event, the tripping frame is configured to turn the tripping axle in relation to the tripping frame by means of the connecting member such that the tripping axle reaches a position in which the at least one tripping spring is able to exert a force on the tripping axle, sufficient to turn the tripping axle to the trip position.

* * * * *